US006390520B1

(12) United States Patent
Holzer

(10) Patent No.: US 6,390,520 B1
(45) Date of Patent: May 21, 2002

(54) DOOR OPENER

(75) Inventor: Michael Holzer, Phoenix, AZ (US)

(73) Assignee: Hanchett Entry Systems, Inc., Phoenix, AZ (US)

( * ) Notice: Subject to any disclaimer, the term of this patent is extended or adjusted under 35 U.S.C. 154(b) by 0 days.

(21) Appl. No.: 09/613,218

(22) Filed: Jul. 10, 2000

(51) Int. Cl.[7] ..... E05B 15/02

(52) U.S. Cl. ..... 292/341.17; 292/341.16

(58) Field of Search ..... 292/341.16, 341.15, 292/341.17, 340

(56) References Cited

U.S. PATENT DOCUMENTS

| | | | | | |
|---|---|---|---|---|---|
| 4,471,983 | A | * | 9/1984 | Bischoff et al. | 292/341.16 |
| 4,480,862 | A | * | 11/1984 | Fleming | 292/162 |
| 4,595,220 | A | | 6/1986 | Hanchett, Jr. et al. | |
| 5,484,180 | A | | 1/1996 | Helmar | |
| 5,490,699 | A | * | 2/1996 | Uyeda | 292/341.16 |
| 5,788,295 | A | | 8/1998 | Fuss et al. | |
| 5,924,750 | A | | 7/1999 | Fuss et al. | |
| 5,934,720 | A | * | 8/1999 | Karalius | 292/341.16 |
| 6,082,791 | A | * | 7/2000 | Frolov et al. | 292/341.16 |
| 6,325,429 | B1 | * | 12/2001 | Oxley | 292/341.16 |

FOREIGN PATENT DOCUMENTS

| | | |
|---|---|---|
| EP | 0279878 | 8/1988 |

* cited by examiner

*Primary Examiner*—Brian L. Johnson
*Assistant Examiner*—Bryan Fischmann
(74) *Attorney, Agent, or Firm*—Frank J. McGue

(57) ABSTRACT

An electric door opening mechanism is disclosed which is operable in either a fail safe and a fail secure mode. The electric door opening mechanism comprises a housing having a cutout portion with an opening adapted to receive a bolt of a door. At least one keeper arm is pivotally mounted to the housing. The keeper arm has a locked position occluding the opening and an open position which allows the bolt to be inserted and withdrawn from the opening. A transmission lever pivotally mounted to the housing releasably engages each keeper arm. When the keeper arm and the transmission lever are engaged, the transmission lever holds the keeper arm in the locked position. A release lever pivotally mounted to the housing is adapted to engage the transmission lever. The release lever has three positions, a first unlocked position, a second locked position and a third unlocked position. When the release lever is in the locked position, it holds the transmission lever in engagement with the keeper arm. The device has a source of electrical power which is used to move the release lever between positions. The device also permits the user to select either a fail safe or a fail secure mode in which the release lever is either in the first unlocked position or the locked position when the source of electrical power is disconnected.

10 Claims, 3 Drawing Sheets

DOOR OPENER

TECHNICAL FIELD

This invention relates to an electric door opener with a keeper subject to the action of an armature and a magnet coil which is selectively positioned for releasing or locking a door latch.

BACKGROUND OF THE INVENTION

A distinction exists between modes of operation for electric door openers, namely, fail safe or fail secure. In the fail safe mode, the door is unlocked unless energized whereas in the fail secure mode the door is locked unless energized. The two modes of operation have generally required two different basic constructions. The use of two different constructions resulted in increased costs for manufacture and stocking of said types.

Further, the structure of electric door openers are subject to a great deal of force when users open and shut such door normally let alone when someone actually attempts to force the door. Such forces can result in damage needing repairs which downtime can defeat the purpose of having the. electric door opener in the first place. Thus, there is a need to reduce the forces acting upon electric door opener structures.

A door opener with a transmission lever is disclosed in EP 279 878 A1. The function of this electric door opener is based on the fact that the transmission lever is held by a release lever armature in the swivelling area of a keeper until the release lever releases the transmission lever by the operation of a magnetic coil. With the aid of a spring , the transmission lever is brought out of the swiveling range of the keeper.

In addition, electric strike mechanisms of the prior art are generally composed of a face plate having the housing for the mechanism projecting rearwardly therefrom. To accommodate such mechanisms, the prior art device require cutting out the doorjamb to install.

U. S. Pat. No. 5,788,295 entitled "Electric Door Opener with Multiple Position Armature Permitting Different Operation Modes" which issued on Aug. 4, 1998 to Fuss et al. discloses an electric door opener with a transmission lever actuable by a release lever and a magnetic coil. The release lever is adjustable by position to release or lock a keeper through a transmission lever. A selector device is provided to switch the system between fail safe and fail secure modes.

None of the known prior art disclose the device set forth herein.

SUMMARY OF THE INVENTION

It is an object of this invention to provide an electric door opener which can be used in either a fail safe or fail secure mode.

It is a further object of this invention to strengthen the locking mechanism of an electric door opener while, at the same time reduce the forces acting upon the structure thereof.

It is still another object of the invention to provide a surface mount electric door opener which eliminates the need to cut out a door jamb to install.

Further objects and advantages of the invention will become apparent as the following description proceeds and the features of novelty which characterize this invention will be pointed out with particularity in the claims annexed to and forming a part of this specification.

BRIEF DESCRIPTION OF THE DRAWINGS

The present invention may be more readily described by reference to the accompanying drawings in which.

DESCRIPTION OF THE PREFERRED EMBODIMENT

Figure 1:
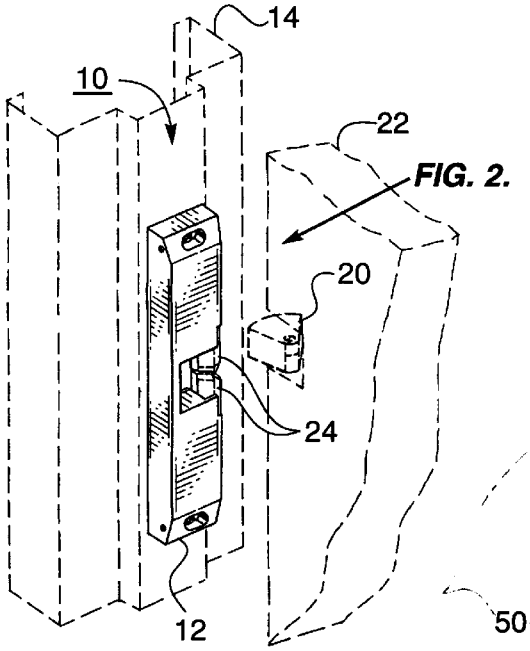
FIG. 1 is a rear and side perspective view of the present invention.
Figure 2:
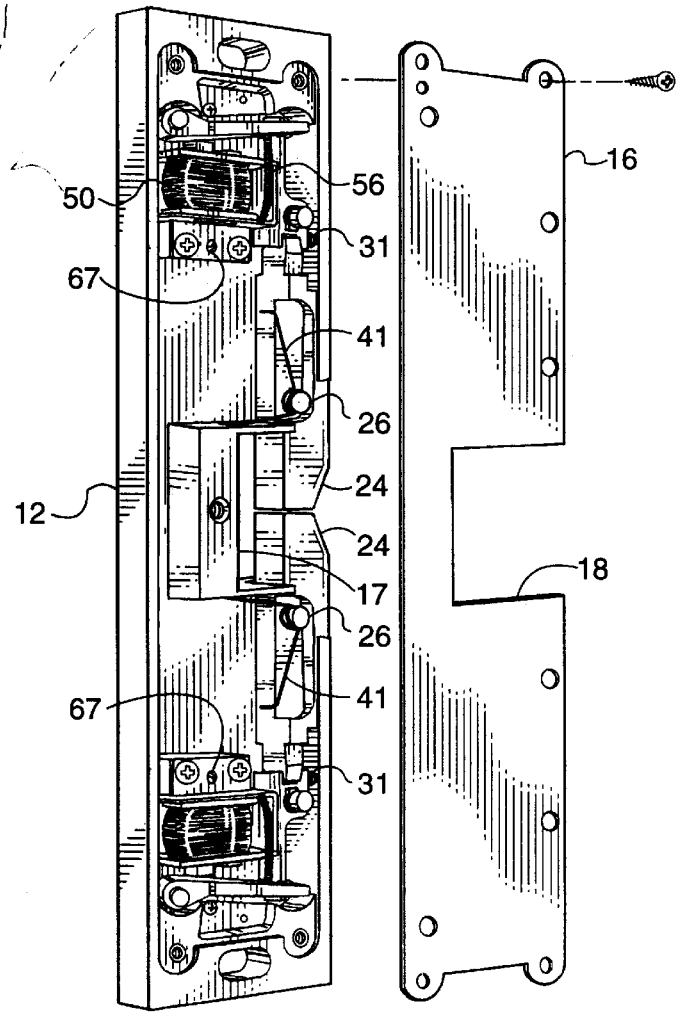
FIG. 2 is a rear and side perspective view of the present invention with a cover removed therefrom.
Figure 3:
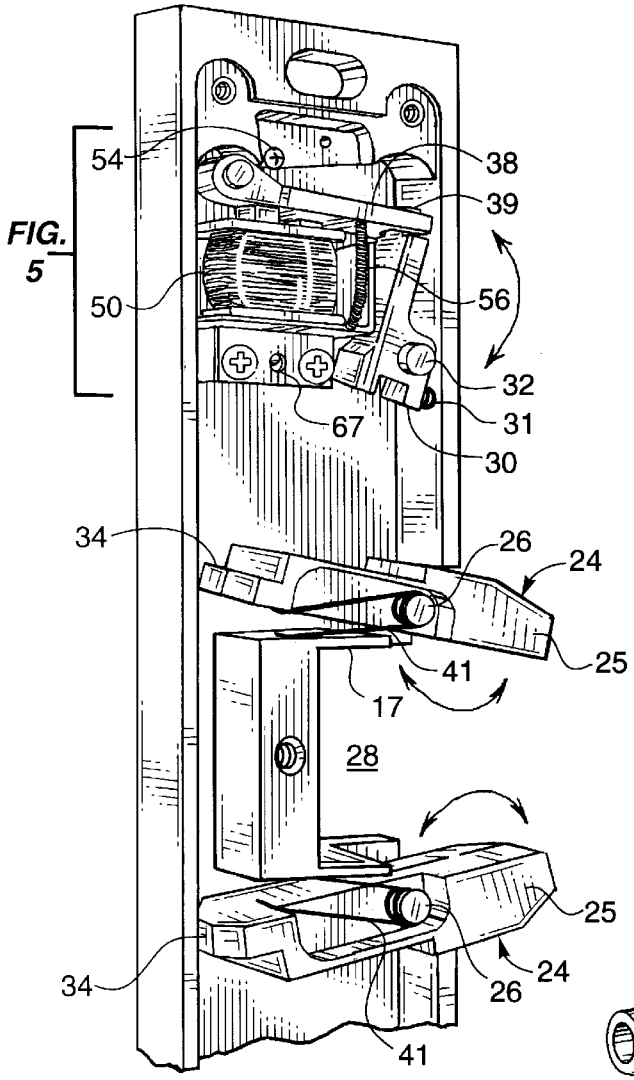
FIG. 3 is a rear and side perspective view of the present invention with the cover removed in an unlocked position.

Referring more particularly to the drawings by characters of reference, FIGS. 1–5 disclose an electric door opening mechanism 10 comprising a housing 12 mounted to a doorjamb 14. A cover 16 protects the interior of housing 10 from tampering as well as dirt, dust and the like while adding strength to the structure. Housing 12 and cover 16 include cutout portions 17 and 18, respectively, which align and are adapted to receive a bolt 20 of a door 22 as best seen in FIG. 3.

As best seen in FIGS. 2 and 3, two opposing keeper arms 24 are mounted at keeper arm pivots 26 positioned proximate to the midpoint of keeper arms 24. Horizontal axis keeper arm pivots 26 are positioned proximate to an opening 28 of cutout portion 17. When keeper arms 24 are vertically oriented in a closed position as shown in FIG. 2, retaining portion 25 of said arms extend into and occlude cutout portion 17 thereby retaining bolt 20 within cutout portions 17 and 18.

As best seen in FIG. 1, bolt 20 is free to rotate only in a counterclockwise direction (when viewed from the perspective of FIG. 1). Thus, when door 22 is shut, bolt 20 rotates to allow passage past keeper arms 24 but then snaps into cutout portion 17. However, once in cutout portion 17, bolt 20 does not rotate in the opposite direction to allow removal therefrom unless keeper arms 24 are in the open position of FIG. 3. Such bolts 20 are well known in the art and the operation thereof will not be further discussed herein.

The use of a pair of keeper arms 24 is presently preferred as the pair is subject to only half of any incoming force which, in turn, means that the strength of the device is essentially doubled. However, the invention contemplates use of a single keeper arm 24 if desired for reasons of cost or if the anticipated forces are not particularly high.

Keeper arms 24 are adapted to engage with transmission levers 30 mounted to housing 12 by transmission lever pivots 32. The axis of rotation of transmission lever pivots 32 is parallel to and aligned vertically with keeper arm pivots 26.

In the presently preferred embodiment, a prong 34 is positioned on each keeper arm 24 opposite retaining portion 25. Prong 34 is received within a fork 36 positioned on a corresponding side of transmission lever 30 when keeper arm 24 is in a closed position, best seen in FIG. 2.

Keeper arms 24 are resiliently urged to the closed position of FIG. 2 by coil springs 41 which are mounted on pivot 26. One arm of coil spring 41 engages keeper arm 24 on its prong side and the other arm engages a sidewall of cutout portion 17. Thus, when prong 34 is released from fork 36, keeper arms 24 are held in the closed position of FIG. 2 only by coil springs 41. To open door 22, a user simply pushes door 22 and bolt 20 pushes keeper arms 24 apart against the coil springs 41. Once bolt 20 clears keeper arms 24, keeper arms 24 rotate back to the closed position under the urging of coil springs 41. To best position transmission lever 30 to receive prong 34, a compression spring 31 is mounted on one end thereof to fork 36 and at the other end thereof to housing 12 proximate to fork 36. Compression spring 31 urges transmission lever 30 away from housing 12 to best position fork 36 to receive prong 34.

As best seen in FIGS. 4 and 5, a release lever 38 is used to control the rotation of each transmission lever 30 from the closed position to a locked position. Release lever 38 is mounted at one end thereof to housing by release lever pivot 40. The axis of rotation of release lever pivot 40 is parallel to but offset laterally from both keeper arm pivot 26 and transmission lever pivot 32. The other end of release lever 38 engages an end 39 of transmission lever 30 opposite fork 36.

Figure 4A:
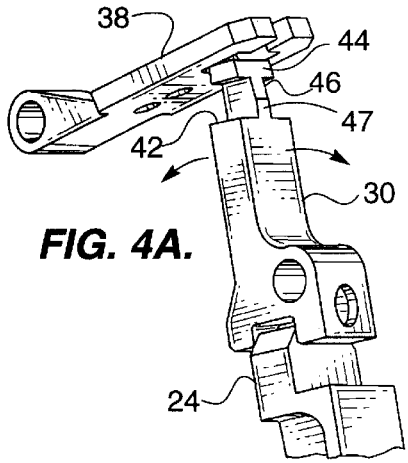
FIGS. 4A, 4B and 4C are perspective close up views of the area designated by the numeral 4 in FIG. 3 showing an unlocked fail safe position, a locked position and an unlocked fail secure position, respectively.
Figure 4B:
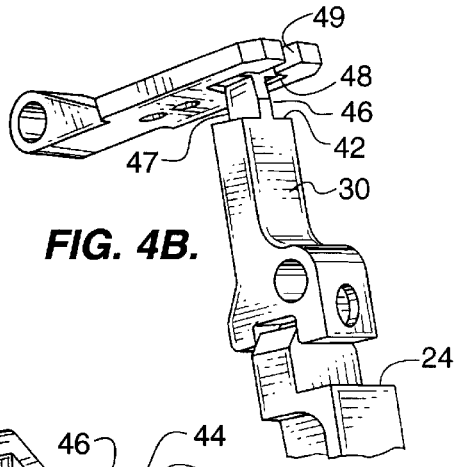
Figure 4C:
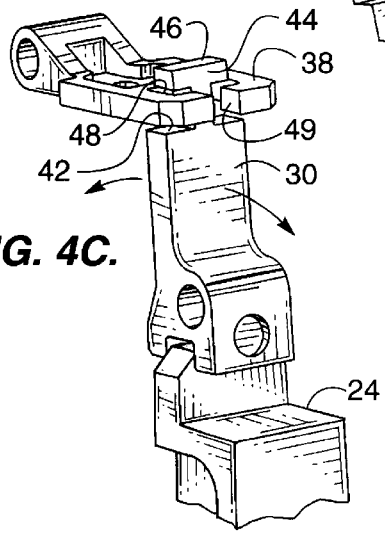

In the presently preferred embodiment and as best seen in FIGS. 4A, 4B and 4C, the end of transmission lever 30 opposite fork 36 is provided with a pair of opposing laterally extending rectangular channels 42 which cut across transmission lever 30. Sidewalls 44 of channels 42 formed furthest from transmission lever 30 in combination with the bottoms of channels 42 form a t-shaped key 46. A corresponding T-shaped opening 48 is provided in release lever 38. A base 49 of T-shaped opening 48 is sized to allow a base 47 of key 46 to freely move therethrough.

The embodiment described provides three positions for release lever 38. In the first, or unlocked fail safe position best seen in FIG. 4A, release lever 38 is completely disengaged from transmission lever 30 thus, thereby allowing transmission lever 30 to freely rotate to the unlocked position.

In the second, or locked, position seen in FIG. 4B, the arms of key 46 are positioned within the arms of opening 48. In this position, key arms 46 cannot move out via opening 48 thereby preventing rotation of transmission lever 30. With transmission lever 30 locked in place, keeper arms 24 are held in the locked position and door 22 cannot be opened.

In the third, or unlocked fail secure, position, best seen in FIG. 4C, release lever 38 is positioned whereby the base 47 of T-shaped key 46 is positioned within the arms of T-shaped opening 48. Since key base 47 can freely move through opening 48, transmission lever 30 can freely rotate to an unlocked position thereby allowing door 22 to be opened as desired.

To control the movement of release lever 38, a magnetic coil 50 is mounted proximate thereto on housing 12 by a pair of coil mounting screws 59A and 59B engaging correspondingly threaded holes 67 . Release lever 38 is manufactured from a material subject to magnetic forces. Thus, whenever, coil 50 is activated, release lever 38 is drawn thereto. A reverse force is provided by a spring 56 which resiliently urges release lever 38 away from coil 50.

Figure 5B:
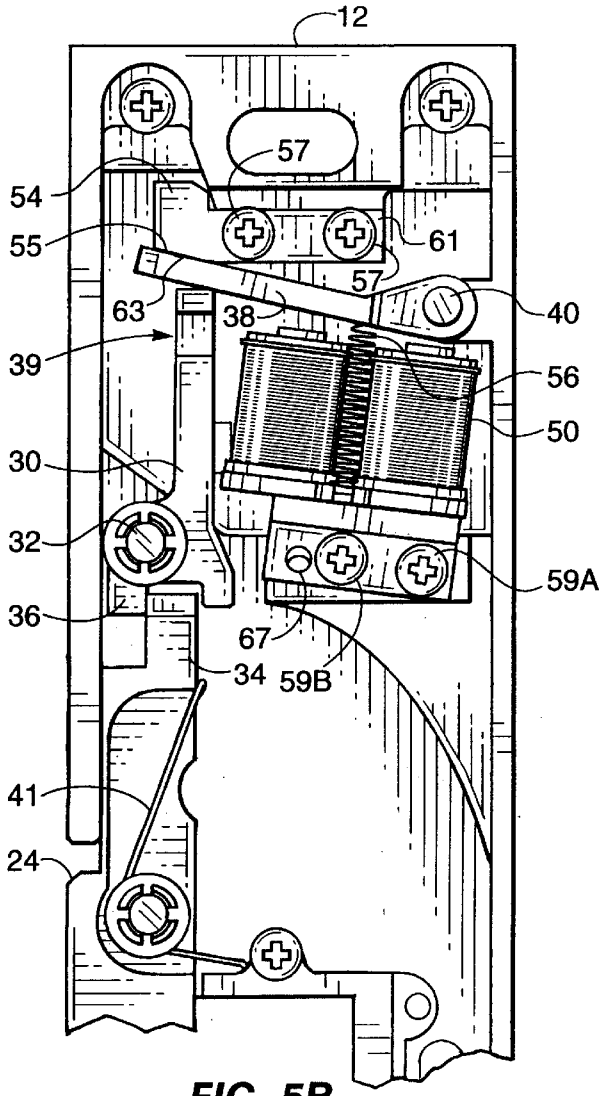
FIGS. 5A and 5B are close up views of the coil area showing a fail secure setting and a fail safe setting, respectively.
Figure 5A:
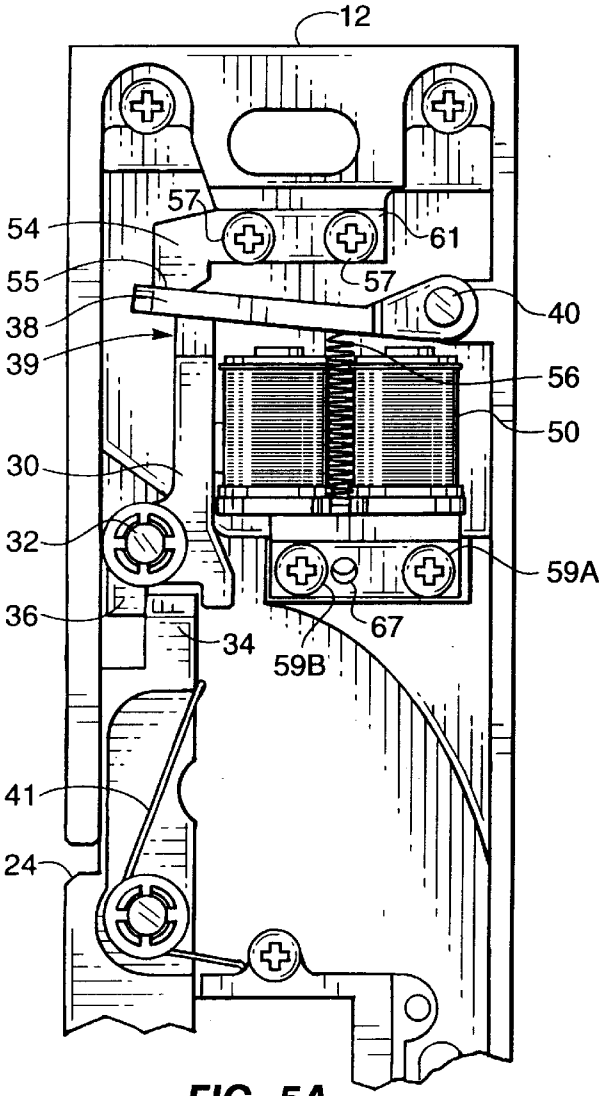

As best seen in FIG. 5A, to provide a fail secure starting position of release lever 38, a stop 54 engages release lever 38 at a point 55 opposite to release lever pivot 40. Stop 54, and in combination with spring 56, holds release lever in the second position, described above, thereby locking the mechanism from opening when the power is off. Stop 54 is mounted to housing 12 by screws 57 attached to a mounting arm 61. When the power is activated, coil 50 pulls release lever 38 towards itself into the third, or unlocked fail secure, position described above thereby unlocking the door. This is the fail secure mode whereby when the power is off, door 22 is locked.

As best seen in FIG. 5B, to provide fail safe starting position, stop 54 and mounting arm 61 are inverted whereby stop 54 no longer engages release lever 38. Instead, a flat side 63 engages, in combination with spring 56, and holds release lever 38 completely disengaged from transmission lever 30 as described in the discussion above relating to the first position of FIG. 4A. The first position allows allows door 22 to be opened freely when the power is off In addition, coil 50 is rotated about screw 59A whereby screw 59B engages another hole 67 and coil 50 is rotated towards release lever 38. When power is activated, coil 50 pulls release lever 38 to itself which holds release lever 38 in the second, or locked, position illustrated in FIG. 4B. Thus, simply reversing stop 54 and rotating coil 50 allows the same mechanism to be employed for both a fail safe and fail secure mode.

Although only certain embodiments have been illustrated and described, it will be apparent to those skilled in the art that various changes and modifications may be made therein without departing from the spirit of the invention or from the scope of the appended claims.

What is claimed is:

1. An electric door opening mechanism operable in a fail safe and a fail secure mode, the electric door opening mechanism comprising:

housing having a cutout portion with an opening adapted to receive a bolt of a door, at least one keeper arm pivotally mounted to the housing, the at least one keeper arm having a locked position occluding the opening and an open position allowing the bolt to be inserted and withdrawn from the opening, a transmission lever corresponding to each of the at least one keeper arm, the at least one transmission lever pivotally mounted to the housing, means for releasably engaging the at least one transmission lever and the at least one keeper arm, the at least one transmission lever holding the at least one keeper arm in the locked position when engaged therewith, a release lever adapted to engage the at least one transmission lever, the release lever being pivotally mounted to the housing, the release lever having a first unlocked position, a second locked position and a third unlocked position, the release lever in the locked position holding the at least one transmission lever in engagement with the at least one keeper arm, the axis of rotation of the release lever, the transmission lever and the at least one keeper arm being parallel, means for moving the release lever between positions, the means for moving the release lever being adapted to operate when connected electrically, means for selecting a fail safe or a fail secure mode in which the release lever is in the first unlocked position or the locked position when the means for moving the release lever is not electrically connected.

2. The device of claim 1 wherein means for releasably engaging the transmission lever and the at least one keeper arm comprises a prong on each keeper arm being received within a fork mounted on each transmission lever.

3. The device of claim 1 wherein the housing further includes a cover, the cover having a cutout portion which corresponds and mates with the cutout portion of the housing.

4. The device of claim 1 having two keeper arms.

5. The device of claim 1 wherein the end of the transmission lever engaged by the release lever includes a T-shaped key which extends from the transmission lever, the T-shaped key being adapted to receive a T-shaped opening on the release lever, arms of the T-shaped opening adapted to firmly engage arms of the T-shaped key, a base of the T-shaped opening adapted to allow the base of the T-shaped key to freely slide therethrough, the first unlocked position having the release lever completely disengaged from the transmission lever;

the second locked position having the arms of the T-shaped key engaging the arms of the T-shaped opening, and the third unlocked position having the base of the T-shaped opening engaging the base of the T-shaped key.

6. The device of claim 1 wherein the means for moving the release lever comprises a magnetic coil mounted proximate thereto, the release lever being made of a material subject to magnetic forces.

7. The device of claim 1 wherein means for selecting comprises an adjustable stop in combination with a spring, the spring resiliently urging the release lever against the stop, the stop positioning the release lever in the desired position when the means for moving the release lever is not electrically connected and a means for moving the magnetic coil to position the release lever in the desired position when the means for moving the release lever is electrically connected.

8. The device of claim 1 wherein the end of the transmission lever engaged by the release lever includes a T-shaped key which extends from the transmission lever, the T-shaped key being adapted to receive a T-shaped opening on the release lever, arms of the T-shaped opening adapted to firmly engage arms of the T-shaped key, a base of the T-shaped opening adapted to allow the base of the T-shaped key to freely slide therethrough, first unlocked position having the release lever completely disengaged from the transmission lever.

9. An electric door opening mechanism operable in a fail safe and a fail secure mode, the electric door opening mechanism comprising:

a housing having a cutout portion with an opening adapted to receive a bolt of a door, two keeper arms pivotally mounted to the housing, each of the two keeper arms having a locked position occluding the opening and an open position allowing the bolt to be inserted and withdrawn from the opening, a transmission lever corresponding to each keeper arm, the transmission lever pivotally mounted to the housing, a prong on each keeper arm being received within a fork mounted on each transmission lever releasably engaging the transmission lever and each keeper arm, the transmission lever holding the keeper arm in the locked position when engaged therewith, a release lever adapted to engage each transmission lever, the release lever being pivotally mounted to the housing, the end of the transmission lever engaged by the release lever including a T-shaped key which extends from the transmission lever, the T-shaped key being adapted to receive a T-shaped opening on the release lever, arms of the T-shaped opening adapted to firmly engage arms of the T-shaped key, a base of the T-shaped opening adapted to allow the base of the T-shaped key to freely slide therethrough, the transmission lever and the release lever having a first unlocked position having the release lever completely disengaged from the transmission lever, and a second locked position having the arms of the T-shaped key engaging the arms of the T-shaped opening, and a third unlocked position having the base of the T-shaped opening engaging the base of the T-shaped key, a magnetic coil mounted proximate to the release lever, the release lever being made of a material subject to magnetic forces, the magnetic coil positioning the release lever in the desired position when the magnetic coil is energized, an adjustable stop in combination with a spring, the spring resiliently urging the release lever against the stop, the stop positioning the release lever in the desired when the magnetic coil is not energized.

10. The device of claim 9 wherein the housing further includes a cover, the cover having a cutout portion which corresponds and mates with the cutout portion of the housing.

* * * * *